US005531086A

United States Patent [19]

Bryant

[11] Patent Number: 5,531,086

[45] Date of Patent: Jul. 2, 1996

[54] KEYLESS ENTRY DEADBOLT LOCK

[76] Inventor: Randy K. Bryant, 20430 C.R. 8, Bristol, Ind. 46507

[21] Appl. No.: 290,068

[22] Filed: Aug. 15, 1994

[51] Int. Cl.[6] ..... E05B 47/00

[52] U.S. Cl. ..... 70/279; 70/280; 292/142; 292/144

[58] Field of Search ..... 70/256, 257, 279, 70/277, 278, 280–283; 292/144, DIG. 25

[56] References Cited

U.S. PATENT DOCUMENTS

| | | | |
|---|---|---|---|
| 3,113,447 | 12/1963 | Oishei | 292/144 X |
| 3,200,623 | 8/1965 | Peters | 70/279 |
| 3,304,755 | 2/1967 | Johnstone | 70/279 |
| 3,396,999 | 8/1968 | Knapp | 292/144 X |
| 4,012,929 | 3/1977 | Solovieff | 70/134 |
| 4,313,320 | 2/1982 | Best et al. | 70/134 |
| 4,322,959 | 4/1982 | Mochida | 70/279 X |
| 4,438,962 | 3/1984 | Soloviff et al. | 292/144 |
| 4,685,316 | 8/1987 | Hicks et al. | 70/256 |
| 4,820,330 | 4/1989 | Lin | 70/277 |
| 4,843,851 | 7/1989 | Frolov | 70/279 X |
| 4,907,429 | 3/1990 | Davis et al. | 70/279 |
| 4,913,475 | 4/1990 | Bushnell et al. | 292/144 |
| 5,009,456 | 4/1991 | Eck | 292/173 |
| 5,010,752 | 4/1991 | Lin | 70/277 |
| 5,027,629 | 7/1991 | Liu | 70/277 |
| 5,040,391 | 8/1991 | Lin | 70/277 |
| 5,095,654 | 3/1992 | Eccleston | 292/144 X |
| 5,113,675 | 5/1992 | Uyeda | 70/477 |
| 5,148,691 | 9/1992 | Walldén | 70/279 |
| 5,181,403 | 1/1993 | Lii | 70/38 C |
| 5,351,512 | 10/1994 | Pearlman | 70/279 X |

*Primary Examiner*—Lloyd A. Gall
*Attorney, Agent, or Firm*—Brett A. Schenck

[57] ABSTRACT

A deadbolt locking system for use on existing locks having a bolt longitudinally moveable between extended and retracted positions by a manual operator mechanism. The system includes an engaging member defining a torque blade key that telescopes a torque blade that extends transversely through a crank hub of the bolt moving mechanism and to a thumbturn. An actuator having a moving member that moves between extended and retracted positions is operatively connected to a connecting rod that is also connected to a torque blade key. The actuator is connected to a signal receiver that receives a signal sent by a transmitter. Upon receiving the signal, the receiver supplies current to the actuator to energize the actuator to move the moving member and connecting rod. This movement rotates the torque blade key to rotate the torque blade that rotates the bolt moving mechanism to move the bolt longitudinally between its extended and retracted positions.

20 Claims, 8 Drawing Sheets

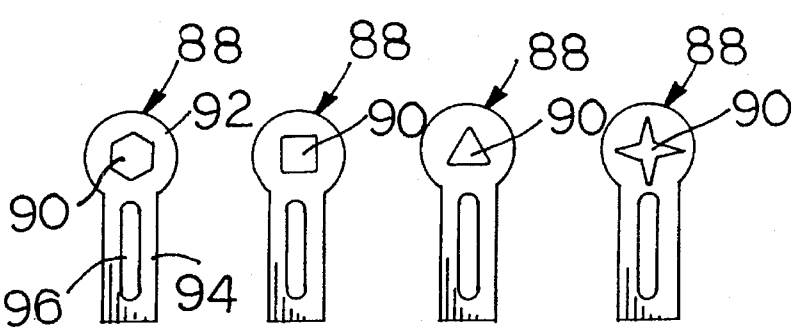
Fig. 8
Fig. 9
Fig. 10
Fig. 11
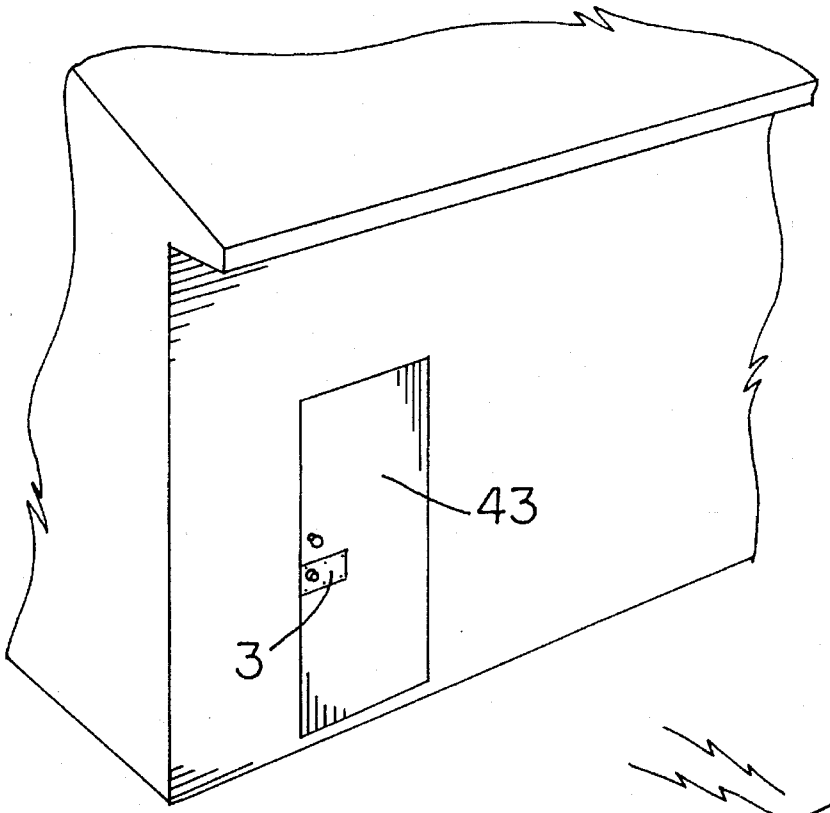
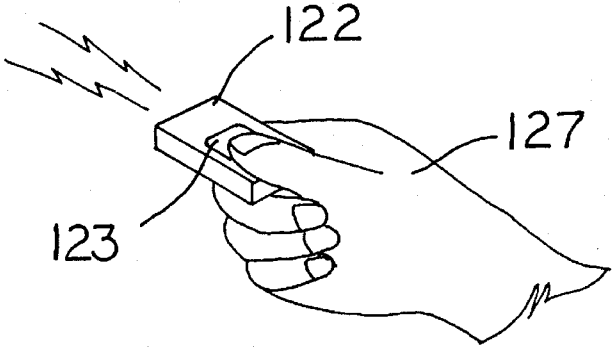
Fig. 7

KEYLESS ENTRY DEADBOLT LOCK

BACKGROUND OF THE INVENTION

The present invention relates to a door lock and more particularly to a deadbolt lock arrangement for use with lock sets of an existing design in homes, offices and other applications. Most deadbolts are locked and unlocked by a key. But often, the key may be lost, the user may have difficulty using the key or it may be inconvenient. This invention solves this problem by utilizing an electronic remote controller to operate an actuator that locks and unlocks the deadbolt but also permits a key or thumbturn to unlock and lock the deadbolt.

It is an object of the present invention to provide a deadbolt lock arrangement which can be opened manually by inserting a key or by a switch or by a RF wireless remote controller.

It is another object of this invention to provide a low cost keyless entry deadbolt lock system which uses existing deadbolt mechanisms on doors for residential and mobile homes, offices, recreational vehicles, boats and the like.

SUMMARY OF THE INVENTION

The present invention is directed to a deadbolt lock arrangement for a door that includes a bolt moveable between a retracted and extended position. A manual operator means is operably connected to the bolt to move the bolt between the extended and retracted position. An engaging member defining a torque blade key telescopes a torque blade that extends transversely through a crank hub of the bolt moving means and to a thumbturn. An actuator having a moving member that moves between extended and retracted positions is operatively connected to a connecting rod that is also connected to the torque blade key. The actuator is connected to a signal receiver that receives a signal sent by a transmitter. Upon receiving the signal, the receiver supplies current to the actuator to energize the actuator to move the moving member and connecting rod. This movement rotates the torque blade key to rotate the torque blade that rotates the bolt moving means to move the bolt longitudinally between its extended and retracted positions.

BRIEF DESCRIPTION OF THE DRAWINGS

These and other features, aspects and advantages of the present invention will become better understood with regard to the following description, appended claims, and accompany drawings where:

FIG. 7 is a fragmentary perspective view of a building showing a door having the modular unit containing the dead bolt locking system, and a user holding a remote control device that operates the dead bolt locking system;

FIG. 8 is a plan view of the torque blade key having a slot and a hexagonal shape aperture;

FIG. 9 is a plan view of the torque blade key having a slot and a square shaped aperture;

FIG. 10 is a plan view of the torque blade key having a slot and a triangular shaped aperture;

FIG. 11 is a plan view of the torque blade key having a slot and a star shaped aperture.

DETAIL DESCRIPTION OF THE INVENTION

Figure 1:
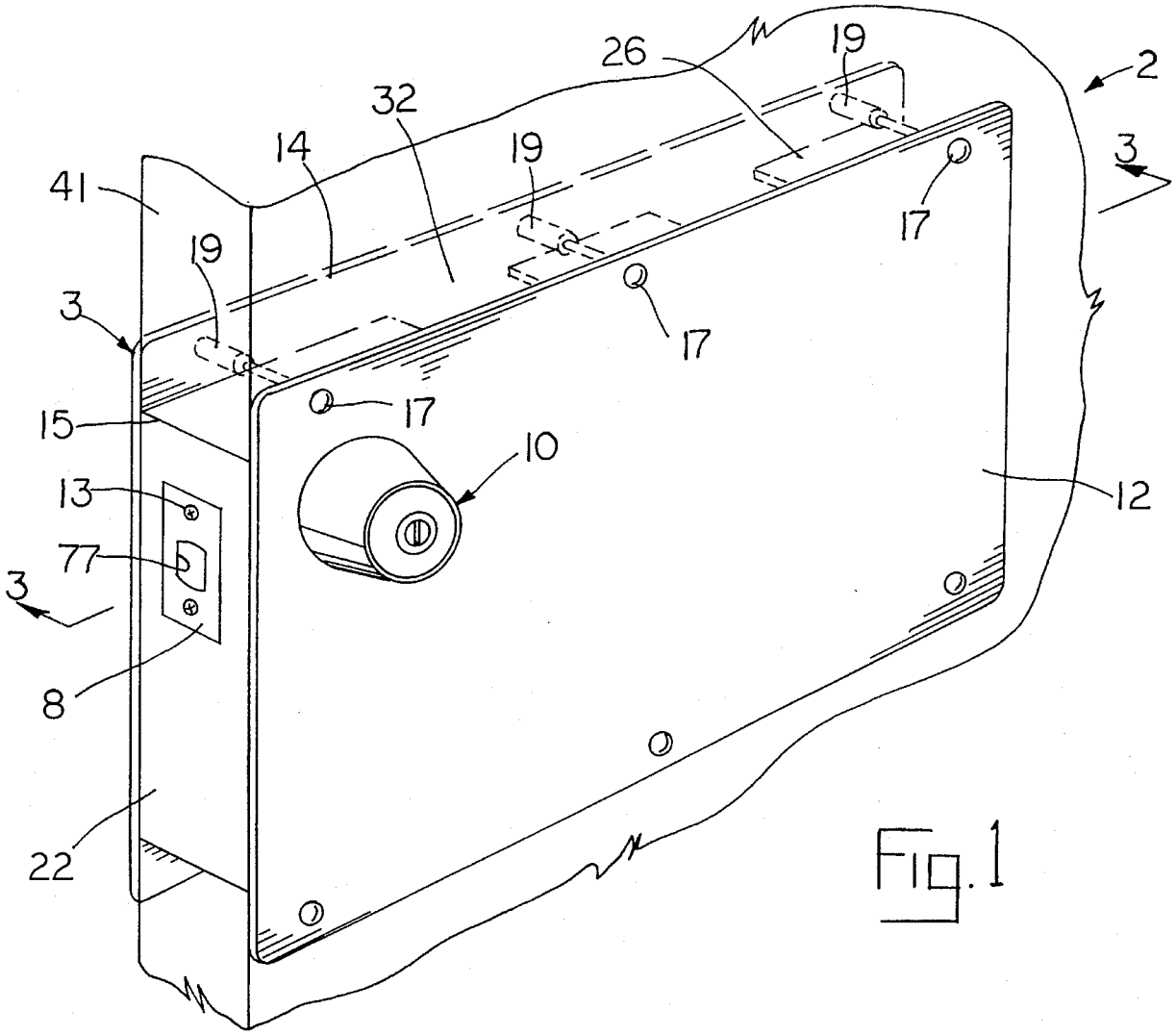
FIG. 1 is a perspective view of a modular unit or kit containing the deadbolt locking system.
Figure 2:
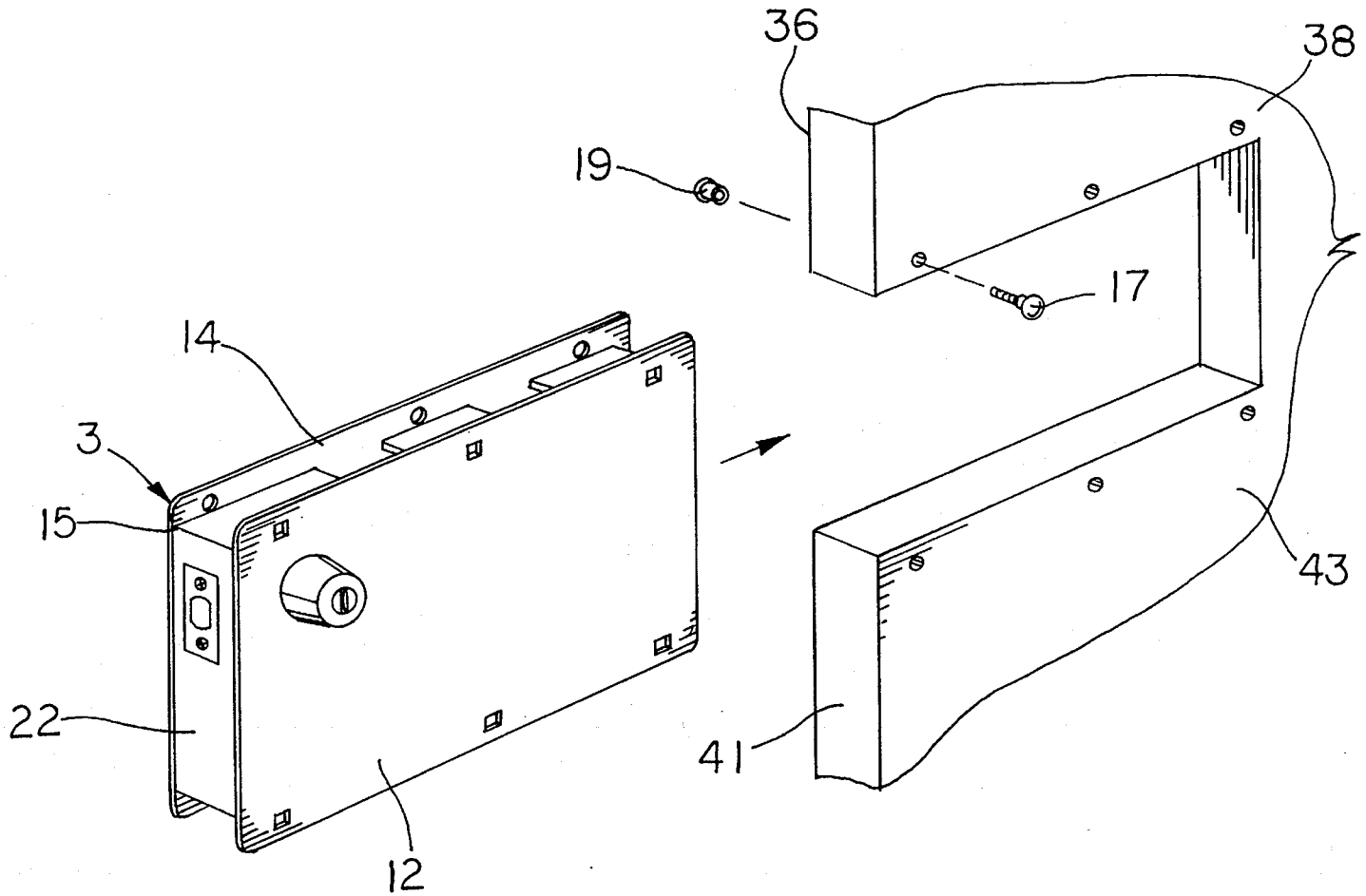
FIG. 2 is a perspective view of the modular unit or kit containing the deadbolt locking system and a fragmentary perspective view of the door with a section cut out illustrating how the modular unit will be installed in the door.
Figure 6:
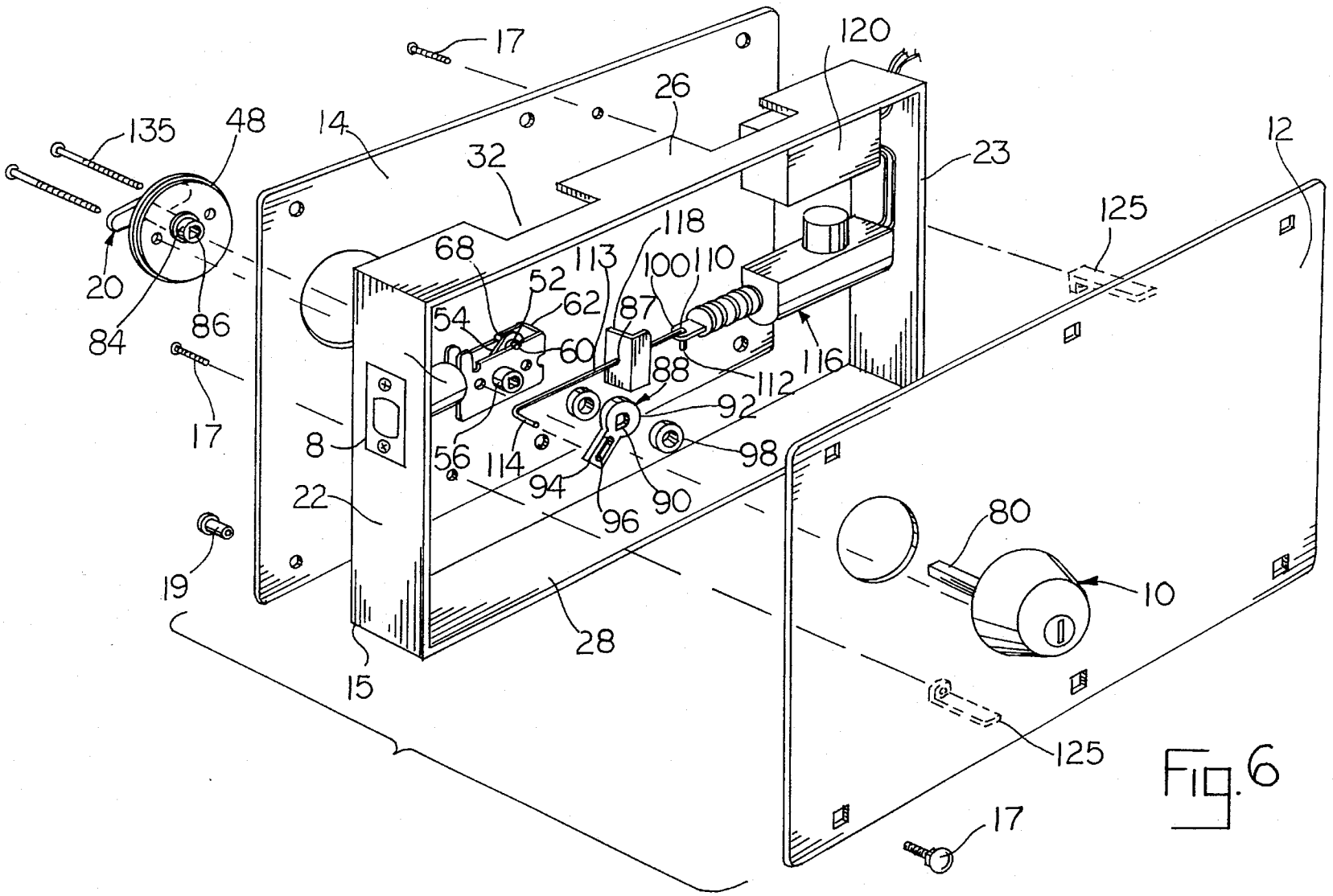
FIG. 6 is an exploded view of the dead bolt locking system.

Referring to the figures, the deadbolt locking system 2 is shown assembled in a kit or modular rectangular housing 3 (FIG. 1 and 6). The housing 3 includes an exterior side or cover 12, and an interior side or cover 14 mounted to a rectangular frame 15 (FIG. 6). The frame has a front portion 22, rear portion 23 (FIG. 6), a top portion 26 and a bottom portion 28 (FIG. 6). The top portion 26 has square openings 32 to permit better signal transmission to the receiver 120. The interior and exterior covers are mounted to one another and the frame 15 by fasteners such as screws 17 and T-nuts 19 and L-shaped tabs 125. The housing 3 is then mounted within a like recess of a door 43 through the interior side 36 and exterior side 38 of the door as shown in FIG. 2. The front portion 22 is flushed with the front side 41 of the door 43 (FIG. 1).

Figure 3:
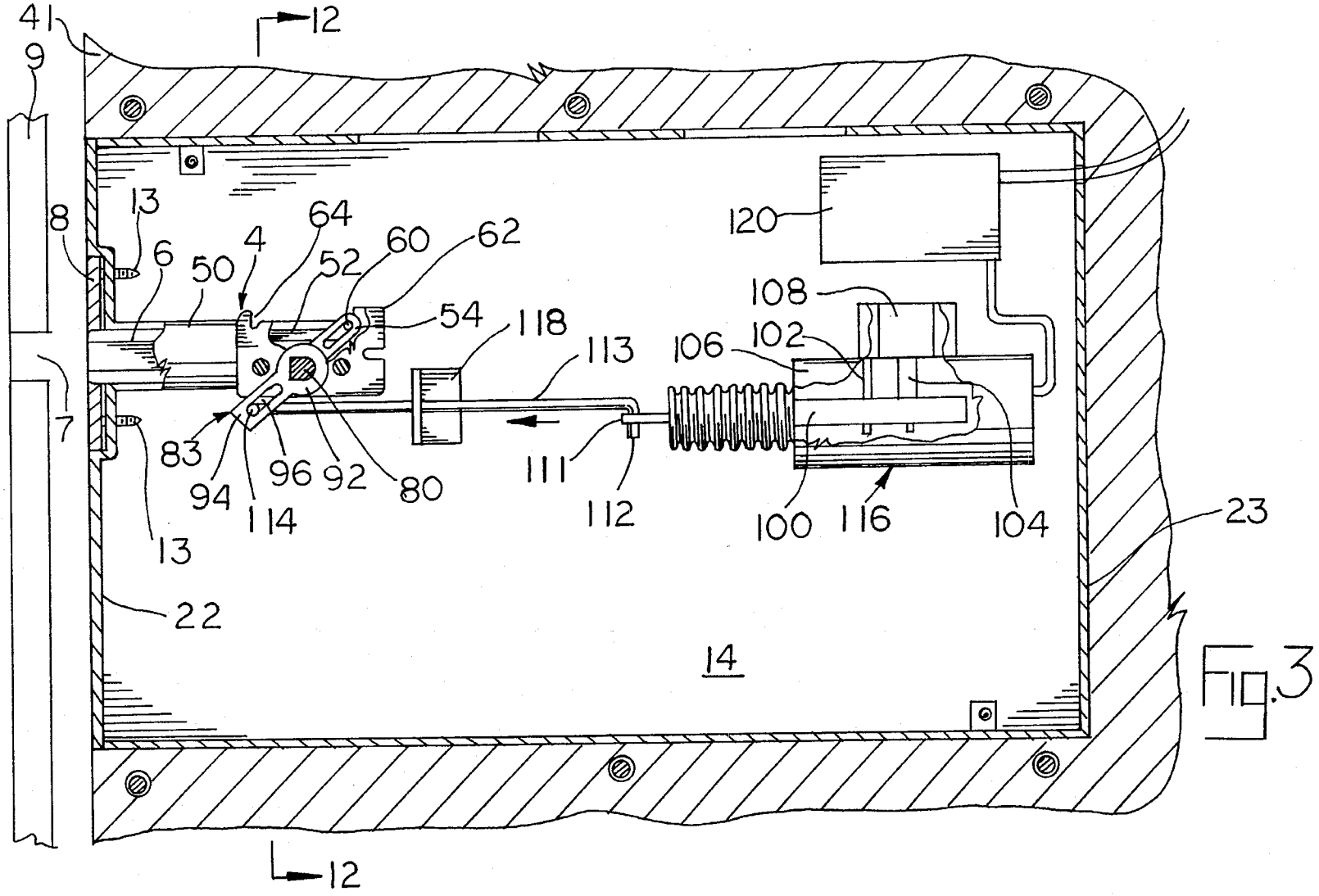
FIG. 3 is a sectional view showing the dead bolt locking system taken along lines 3—3 of FIG. 1 and with some portions cut away.
Figure 12:
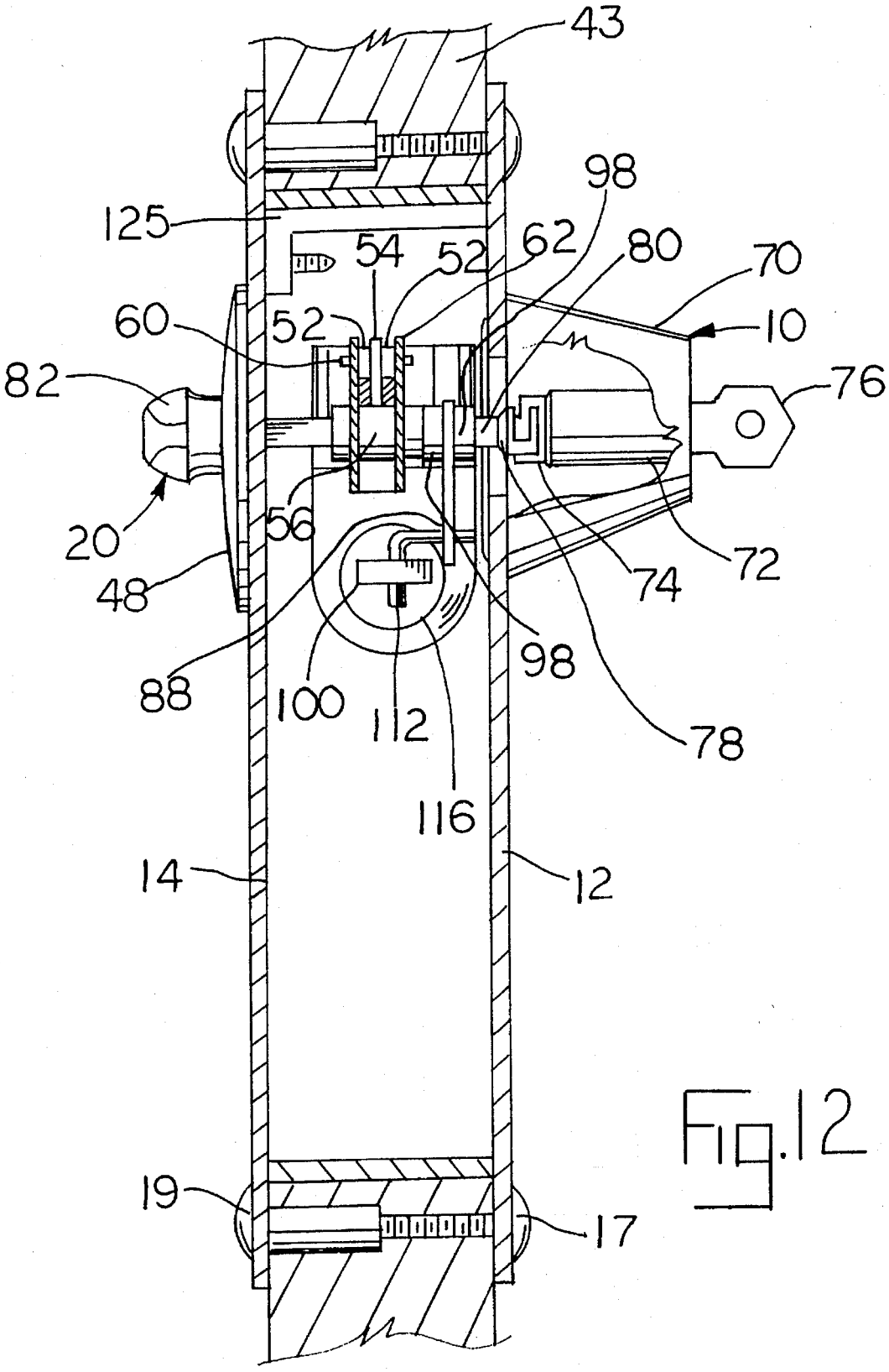
FIG. 12 is a front sectional view of the dead bolt locking system taken along line 12—12 of FIG. 3.

Referring to FIG. 3 and 6, the bolt assembly is of common construction including a standard bolt 6 and bolt moving means 4, a first manual operator preferably in the form of a pin-type, key actuated lock 10, a second manual operator preferably in the form of a thumbturn 20, and a remote control with an actuator. The bolt 6 and bolt moving means 4 is mounted within the front portion 22 and through an aperture 77 of a faceplate 8 that is mounted to the front portion 22 by screws 13 as shown in FIG. 1 and 3. The bolt 6 extends generally longitudinally in alignment with the bolt keeper or strike hole 7 of the door jamb 9 (FIG. 4) and the lock 10 is mounted at the exterior cover 12 transversely connected to the bolt 6 and bolt moving means 4 (FIG. 6 and 12). The thumbturn 20 is mounted at the interior cover 14 by two machine screws 135 and is also transversely connected to the bolt 6 and bolt moving means 4, the thumbturn 20 being mounted within a case 48 secured to the interior cover 14 as seen in FIGS. 6 and 12.

Figure 4:
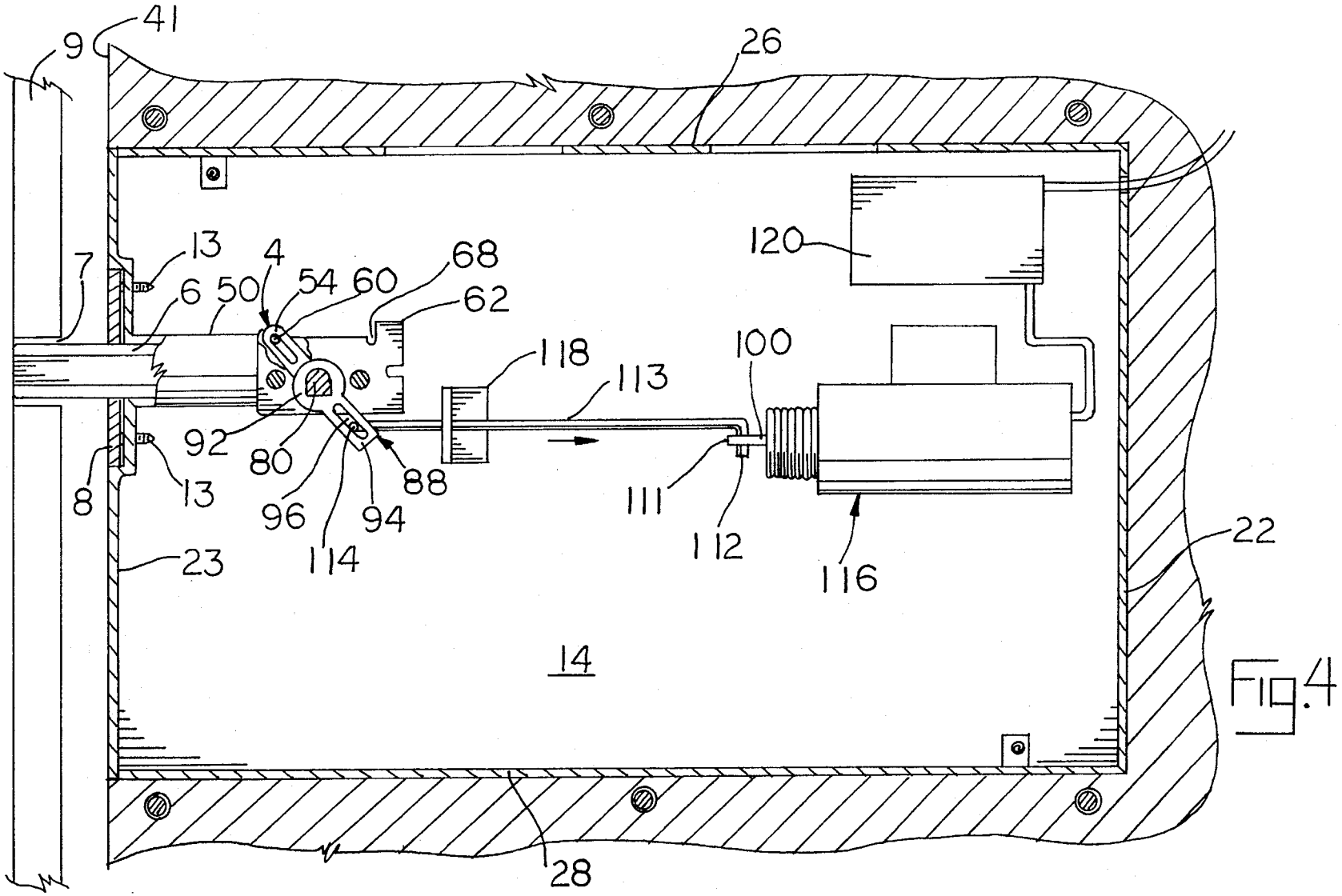
FIG. 4 is a sectional view, as in FIG. 3 showing the dead bolt locking system in the locked position.

The bolt and bolt moving means includes a deadbolt 6 longitudinally movable in a bolt housing 50 between a fully retracted position completely within the front portion 22 as shown in FIGS. 1 and 3, and a fully extended position as shown in FIG. 4 projecting a maximum distance into the bolt keeper 7 of the door jamb 9. The bolt housing 50 guidingly supports the bolt 6 for reciprocal axial movement within the housing and aperature 77 of the faceplate 8. The deadbolt 6 is moved longitudinally by a pair of driving levers 52 (FIG. 12) pivotally connected at their forward ends to the deadbolt 6 and rearwardly pivotally connected to a crank arm 54 partially rotatable by a crank hub 56, all operably mounted within a latch frame 62 as also seen in FIG. 3 and 4.

The pivotal connection between the rearward ends of driving levers 52 and the crank arm 54 is formed by a transverse drive pin 60 which is of increased length to project axially over the latch frame 62. A transversely aligned pair of guide slots 64 (FIG. 3) is formed in the latch frame 62 just longitudinally rearwardly of the bolt housing 50 for receiving the ends of the described drive pin 60 when the deadbolt 6 is in its fully extended position (FIG. 4). These resist rearward driving of the bolt by an outside force attempting to move the bolt longitudinally rearwardly from its fully extended position other than by the crank arm 54 and crank hub 56. Likewise, a transversely aligned pair of guide slots 68 (FIG. 4) is formed in the latch frame longitudinally rearwardly of the guide slots 64 for receiving the ends of the drive pin when the deadbolt 6 is in its fully retracted position as shown in FIGS. 1 and 3. These resist forward driving of the bolt by an outside force attempting to move the bolt longitudinally forwardly from its fully retracted position other than by the crank arm 54 and crank hub 56.

As shown in FIG. 12, the lock 10 at the door exterior side 38 is of common construction including a lock frame or cover 70 transversely abutting the exterior cover 12 and mounting a lock cylinder 72 which in turn mounts a lock plug 74 rotatable about a transverse axis. The lock is of the usual pin type and the lock plug 74 is manually used in usual manner by a key 76. The lock plug 74 is axially connected through a usual lost motion connection 78 to a transversely extending torque blade 80 which extends through crank hub 56 of the bolt and bolt moving means non-rotatable relative thereto, but, selectively transversely slideably movable relative thereto.

The lock cylinder 72 and its telescoped lock plug 74 are transversely or axially selectively movable relative to the lock frame 70. In this transverse movement of the lock cylinder 72 and the lock plug 74, the torque blade 80 is carried transversely with the lock plug sliding transversely through the crank hub 56. Thus, in any transverse position of the lock cylinder 72 and lock plug 74, the lock 10 is conventionally operable by the key 76 for moving the deadbolt 6 fully between its extended and retracted positions with the lost motion connection 78 permitting return of the lock plug 74 to a neutral position wherein the key 76 may be removed as is commonly known. At the interior cover 14, the thumbturn 20 is rotatably mounted by the case 48 having an outer end 82 (FIG. 6) accessible outwardly of the case 48 and projecting transversely through the case. An axial or transverse recess 86 (FIG. 6) is formed at an inner end 84 of the thumbturn 20 in transverse alignment with and transversely slideably receiving the torque blade 80 non-rotatable relative thereto. When the thumbturn 20 is in normal transverse position as shown in FIG. 12, the torque blade 80 is telescoped by the thumbturn 20 substantially the entire transverse length of the recess 86. The thumbturn 20 is mounted selectively transversely movable relative to the case 48 and the torque blade 80. As is commonly known, the thumbturn 20 may be selectively manually rotated for moving the deadbolt 6 between its extended and retracted positions without rotation of the lock plug 74 of the lock 10 due to the lost motion connection 78 previously destibed.

An engaging member defining a torque blade key 88 that is flat and shaped like a key has an aperature 90 of similar shape as the torque blade section in its circular head portion 92 and a slot 96 in its rectangular extended portion 94. The torque blade key 88 fits around the torque blade 80 between the latch frame 62 and lock cylinder 72 (FIG. 6 and 12) such that the torque blade extends through the aperture 90 non-rotatable relative thereto, but selectively transversely slideably movable relative thereto. It should be noted that the aperture 90 of the torque blade key 88 can be of any shape to accommodate a torque blade having a like sectional shape such as a hexagonal (FIG. 8), square (FIG. 9), triangular (FIG. 10), or star (FIG. 11). The torque blade 80 further extends through a pair of spacers 98 as seen in FIG. 12. One spacer is located between the torque blade key 88 and latch frame 62 while the other is located between the torque blade key 88 and lock cylinder 72. These spacers properly position the torque blade key 88 so that a connecting rod can fit into the slot 96, which will be explained later.

A push/pull actuator 116 manufactured by Bockette is mounted to the interior cover 14 of the housing adjacent the lock as shown in FIG. 3. The actuator is encased by a housing 106 and has an elongated moving member 100 with teeth conventionally engaging a gear segment 102 which in turn engages a worm gear 104 operarely connected to an electric motor 108. Upon electrical actuation, the electric motor 108 will rotate the worm gear 104 which rotates the gear segment 102 that moves the moving member longitudinally. The moving member 100 has an aperture 110 (FIG. 6) at its tip 111 for receiving a connecting rod 113. The connecting rod 113 has hook shaped portions 112 and 114 on each end. One portion 112 extends through the aperture 110 of the moving member 100 and the other portion 114 extends downwardly through the slot 96 of the torque blade key 88, properly positioned by the spacers 98. The actuator 116 longitudinally moves the connecting rod 113 axially in an extended and retracted position. The connecting rod further extends through an aperture 89 (FIG. 6) in an angle or guide bracket 118 mounted to the interior cover 14 and located between the actuator 116 and torque blade key 88. The bracket 118 guides and supports the connecting rod preventing it from wobbling and falling off the slot as it moves longitudinally, and also properly positions the hook portion 114 along the slot. This position is that the hook portion 114 just contacts the bottom of the slot when the connecting rod is in its extended position that places the deadbolt 6 in its retracted position.

Figure 5:
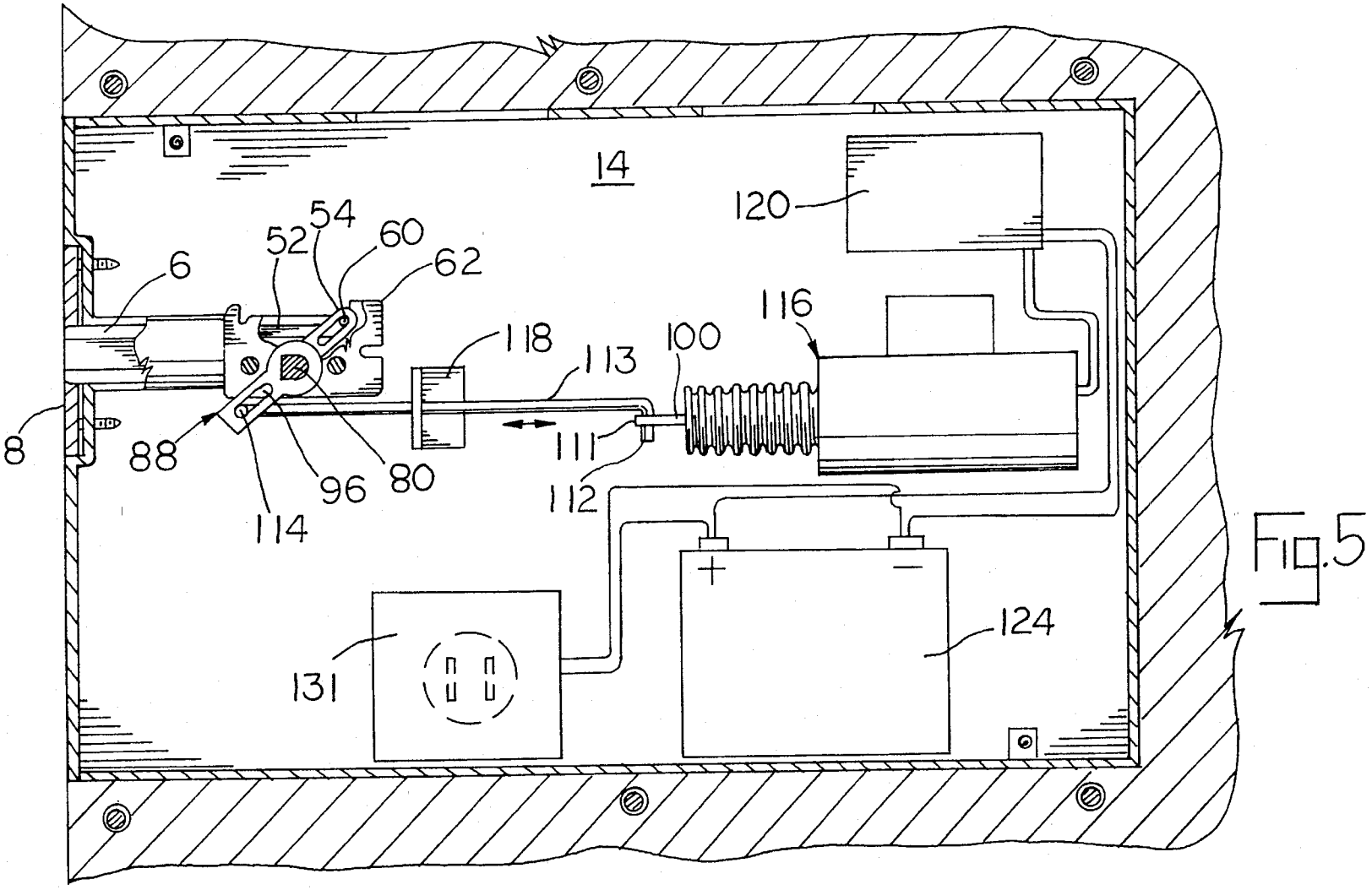
FIG. 5 is a sectional view, as in FIG. 3 showing the dead bolt locking system utilizing a battery arrangement to power the system.

A remote control means is used to energize the actuator. The remote control means includes a wireless signal receiver 120 mounted to the interior cover 14 and is electrically connected to the actuator 116. The receiver 120 is a single channel 12 volt remote manufactured by Bockette. A timing relay in the receiver 120 is activated for three seconds by a signal to connect a source of power so that current flows to the actuator 116 activating it. This source of power can be from a house current (FIG. 3 and 4) that is converted to 12 Vdc or a rechargeable battery 124 that can be charge by the house current convertered to 12 Vdc by a conventional A/D converter 131 as shown in FIG. 5. A wireless transmitter 122 that can be held in the hand 127 of a user and fitted on a key ring similar to those used to unlock car door locks is provided as shown in FIG. 7. The transmitter 122 includes a pushbutton 123 and sends a signal, when the button is pressd, to the receiver. It should be noted that the receiver 120 or actuator 116 can be activated by a switch mounted to the door, door lamb or house and wired to the receiver or actuator.

In operation, the deadbolt 6 as shown in FIG. 3 is seen in its retracted position. To manually actuate the deadbolt to move it from the fully retracted position to its fully extended position by the lock at the exterior cover 12, the key is inserted in the lock and turned in the appropriate direction that first overcomes the lost motion connection 78 in the usual manner and then rotates the torque blade 80 that rotates the crank hub 56 to move the deadbolt 6 to its extended position. Likewise, rotation of the thumbturn 20 will rotate the torque blade which rotates the crank hub to move the deadbolt 6 to its extended position locking the door 43. The key 76 and thumbturn 20 can then be rotated in the opposite direction to move the dead bolt longitudinally in its retracted position unlocking the door. It should be noted that during the torque blade rotation, the gears are allowed to rotate thus permitting the connecting rod and moving member to freely move longitudinally in response to rotation of the torque blade key 88.

The deadbolt 6 is actuated electrically by the remote control means as follows. A user depresses the button 123 on the wireless transmitter 122 (FIG. 7) that transmits a signal to the receiver to energize the timing relay for three seconds that connects a power source to supply current to the actuator 116. The current energizes the motor in the actuator that rotates the gears to longitudinally move the elongated moving member 100 and connecting rod 113 rearward which rotates the torque blade key 88 approximately 90 degrees. The torque blade key 88, while rotating, rotates the torque blade 80 which rotates the crank hub 56 to move the deadbolt 6 longitudinally in its extended position locking the door 43. The deadbolt 6 can be moved back to its retracted position unlocking the door by reverse actuation thereof. That is by depressing the button 123 on the transmitter 122 to send a signal to the receiver 120 that energizes the timing relay to connect the power source to supply a current of opposite value to the actuator 116. This current energizes the motor 108 that rotates the gears to push or move the moving member 100 and connecting rod 113 forward to rotate the torque blade key 88, torque blade 80, and crank hub 56 ninety (90) degrees in the opposite direction moving the deadbolt in its retracted position.

The previously described invention has many advantages including, the incorporation of the push/pull actuator and remote controller or transmitter that is used on car door locks to that on a deadbolt locking system. Further, the torque blade key, spacers, connecting rod and angle bracket allow the other elements to operate existing deadbolt locks while still permitting the deadbolt to be locked and unlocked manually by the conventional key and thumbturn. Additional changes and modifications to the embodiment of the invention as described herein can also be made, as will be apparent to those skilled in the art, while still remaining within the spirit and scope of the disclosed invention as set forth in the appended claims.

What is claimed is:

1. A locking system for a door comprising:

a bolt movable between a retracted and extended position;

a manual operator means operatively connected to said bolt for moving said bolt between said extended and retracted positions upon manual actuation;

an engaging member telescoping a part of said manual operator means, said part having an axis of rotation extending transversely to a line along which said bolt moves;

said engaging member having a slot extending substantially radially from an axis of rotation of the engaging member; and an actuator having gear means and an elongated moving member, said elongated moving member having a plurality of teeth, said gear means having a gear segment that engages said teeth of said elongated moving member to longitudinally move said elongated moving member between extended and retracted positions upon rotation of said gear means, said moving member operatively connected to said engaging member slot to rotate said engaging member to rotate said part that moves said bolt longitudinally between its extended and retracted positions upon energization of said actuator to operate said gear means to rotate said gear segment that longitudinally moves said moving member between extended and retracted positions.

2. The locking system of claim 1 wherein said manual operator means includes a lock having a rotatable lock plug operatively connected to said bolt for moving said bolt between said extended and retracted positions upon rotation of said lock plug.

3. The locking system of claim 1 wherein said manual operator means includes first and second manual operators each operatively connected to said bolt, said first manual operator being a lock having a rotatable lock plug and said second manual operator being rotatable, said bolt being moved between its extended and retracted positions upon rotation of either of said first manual operator lock plug and said second manual operator.

4. The locking system of claim 1 including a remote control means for transmitting a signal that energizes said actuator.

5. The locking system of claim 1 wherein a remote control means includes a transmitter and a receiver, said receiver connected to said actuator, said transmitter transmitting a signal that is received by said receiver that supplies current to said actuator to energize said actuator.

6. The locking system of claim 1 including a connecting rod, said rod having an end defining a hook portion, said hook portion of said rod extending into said slot slidably engaging said engaging member, said rod further being connected to said moving member.

7. The locking system of claim 6 including a bracket mounted to a housing enclosing said locking system, said rod extending through an aperture of said bracket to support and guide said rod.

8. The locking system of claim 6 wherein said part of said manual operator means is a torque blade, said manual operator means being rotatable about a transverse axis rotating said torque blade thereof, said engaging member being a torque blade key, said torque blade key having a head portion, said head portion having an aperture, said torque blade extending through said aperture slidably engaging said torque blade key, said torque blade key having an extended portion, said extended portion having said slot.

9. The locking system of claim 8 including a pair of spacers located adjacent said torque blade key, said torque blade extending through said spacers.

10. The locking system of claim 6 wherein said connecting rod defines a hook portion at another end, said hook portion extending through an aperture of said moving member securing said connecting rod to said moving member.

11. The locking system of claim 6 including a transmitter and a receiver, said receiver connected to said actuator, said transmitter transmitting a signal that is received by said receiver that supplies current to said actuator to energize said actuator.

12. The locking system of claim 1 wherein said part of said manual operator means is a torque blade, said manual operator means being rotatable about a transverse axis rotating said torque blade thereof, said engaging member being a torque blade key, said torque blade key having a head portion, said head portion having an aperture, said torque blade extending through said aperture slidably engaging said torque blade key, said torque blade key having an extended portion, said extended portion having said slot.

13. The locking system of claim 1 wherein said manual operator means includes a crank having a hub and an arm, said arm operatively connected to said bolt, said part of said manual operator means extending through said hub rotatably engaging said hub to rotate said arm to move said bolt between extended and retracted positions.

14. The locking system of claim 1 including a modular housing enclosing said system, said housing having an interior cover and an exterior cover, said housing including a frame disposed between said exterior and interior cover.

15. A locking system for a door comprising:

a bolt movable between a retracted and extended position;

a manual operator means operatively connected to said bolt for moving said bolt between said extended and retracted positions upon manual actuation, said manual operator means including a torque blade having an axis of rotation extending transversely to a line along which said bolt moves, said manual operator means being rotatable about a transverse axis rotating said torque blade thereof;

a torque blade key telescoping said torque blade, said torque blade key having a head portion, said head portion having an aperture, said torque blade extending through said aperture slidably engaging said torque blade key, said torque blade key having an extended portion, said extended portion having a slot extending substantially radially from an axis of rotation of the torque blade key; and an actuator having a moving member that moves between extended and retracted positions, said moving member operatively connected to said torque blade key slot to rotate said torque blade key which in turn rotates said torque blade that moves said bolt longitudinally between its extended and retracted position upon energization of said actuator that longitudinally moves said moving member between extended and retracted positions.

16. The locking system of claim 15 including a connecting rod, said rod having an end defining a hook portion, said hook portion extending into said slot of said extended portion of said torque blade key and slidably engaging said torque blade key, said rod further being connected to said moving member.

17. The locking system of claim 16 including a remote control means for transmitting a signal that energizes said actuator, said remote control means including a transmitter and a receiver, said receiver connected to said actuator, said transmitter transmitting a signal that is received by said receiver that supplies current to said actuator to energize said actuator.

18. The locking system of claim 17 including a bracket mounted to a housing enclosing said locking system, said rod extending through an aperture of said bracket to support and guide said rod.

19. The locking system of claim 18 including a pair of spacers located adjacent said torque blade key, said torque blade extending through said spacers.

20. The locking system of claim 18 wherein said connecting rod defines a hook portion at another end, said hook portion extending through an aperture of said moving member securing said connecting rod to said moving member.

* * * * *